US008888335B2

(12) United States Patent
Wang

(10) Patent No.: US 8,888,335 B2
(45) Date of Patent: Nov. 18, 2014

(54) LIGHTING SYSTEM

(75) Inventor: Peng Wang, Shanghai (CN)

(73) Assignee: GE Lighting Solutions, LLC, Cleveland, OH (US)

( * ) Notice: Subject to any disclaimer, the term of this patent is extended or adjusted under 35 U.S.C. 154(b) by 444 days.

(21) Appl. No.: 13/154,102

(22) Filed: Jun. 6, 2011

(65) Prior Publication Data

US 2011/0317435 A1 Dec. 29, 2011

Related U.S. Application Data

(60) Provisional application No. 61/358,113, filed on Jun. 24, 2010.

(51) Int. Cl.

| | |
|---|---|
| ***F21S 8/06*** | (2006.01) |
| ***F21V 21/02*** | (2006.01) |
| ***F21V 21/30*** | (2006.01) |
| *F21Y 101/02* | (2006.01) |
| *F21Y 103/00* | (2006.01) |

(52) U.S. Cl.

CPC ..... *F21V 21/025* (2013.01); *F21Y 2101/02* (2013.01); *F21Y 2103/003* (2013.01); *F21V 21/30* (2013.01)

USPC ..... 362/370

(58) Field of Classification Search

CPC ..... F21V 21/30; F21V 21/04; F21V 17/02; F21V 23/02

USPC ..... 362/370

See application file for complete search history.

(56) References Cited

U.S. PATENT DOCUMENTS

| | | | | |
|---|---|---|---|---|
| 5,226,724 | A * | 7/1993 | Kanarek | 362/260 |
| 2003/0103347 | A1* | 6/2003 | Friend | 362/225 |
| 2008/0068834 | A1 | 3/2008 | Cunningham et al. | |
| 2009/0109670 | A1* | 4/2009 | Boyer | 362/234 |
| 2009/0213621 | A1 | 8/2009 | Hierzer | |

FOREIGN PATENT DOCUMENTS

| | | |
|---|---|---|
| DE | 20 2009 004333 | 5/2010 |
| DE | 20 2010 002018 | 5/2010 |
| WO | WO 2009/055334 | 4/2009 |

OTHER PUBLICATIONS

Search Report from Application No. EP 11170802.0.

* cited by examiner

*Primary Examiner* — Anh Mai
*Assistant Examiner* — Brenitra M Lee
(74) *Attorney, Agent, or Firm* — Fay Sharpe LLP

(57) ABSTRACT

A lighting system including a track member and a lighting unit supported by the track member 14. The track member includes an elongate base for mounting the track member to a surface, such as a wall, frame, etc. A pair of arms 26 and 30 extend from the base 22 in a common direction and define therebetween a channel 34 for receiving the lighting unit 18. Rotationally interlocking members associated with each at least one of the track member and the lighting unit restrict rotation of the lighting unit relative to the track member when the arm is in a first position. Upon application of a threshold rotational force to the lighting unit, the at least one arm moves to a second position permitting angular adjustment of the lighting unit.

15 Claims, 10 Drawing Sheets

LIGHTING SYSTEM

RELATED APPLICATIONS

This application claims priority to U.S. Provisional Application No. 61/358,113 filed on Jun. 24, 2010, which is hereby incorporated herein by reference in its entirety.

BACKGROUND

The following relates to the illumination arts, lighting adunn[rts, and related arts.

A wide variety of indirect lighting and architectural lighting fixtures are known. One particular area of indirect lighting is often referred to as cove lighting. In a typical cove lighting installation, an upwardly open channel is built along a wall near the ceiling, for example. The wall may be a side wall of the room, a sidewall of a recess in the ceiling, a side surface of a beam, or the like. Lighting units are mounted within the channels so that the emitted light escapes generally upward to directly light the wall and ceiling above and, indirectly, an interior of the room and its contents. Such channels are often built with conventional building techniques involving framing, sheetrocking/plastering, etc. Cove lighting can also be installed in cabinets or display cases, or virtually anywhere such lighting is desired.

In a typical cove lighting installation, a track is first secured to a mounting surface, and then one or more lighting units are installed to the track. Before or after installation of the lighting units to the track, the lighting unit can be wired or otherwise connected to a power source.

In some installations, it can be advantageous or desirable to aim the lighting units to thereby direct the light emanating therefrom to a particular locations. For example, the lighting units may be aimed to achieve uniform distribution of the light along a wall or ceiling, or to focus on a specific architectural feature, etc. One manner in which prior art lighting units can be aimed is by installing a track with a particular angular offset. For example, a lighting system might include a variety of tracks having various angular offsets, for example, 90 degrees, 60 degrees, 45 degrees 30 degrees, etc. During installation, the installer can select and install the track with the appropriate offset to achieve the desired angular position of the lighting unit.

Another prior art approach has been to rotatably support the lighting unit with a base assembly that can be mounted to the track. Once the base assembly is secured to the track, the lighting unit can be rotated relative to the base assembly to aim the light.

Such prior art systems require extra parts in the form of additional track elements and/or the rotatable base assembly. This can add additional manufacturing costs and can complicate installation by necessitating additional steps.

BRIEF SUMMARY

Embodiments are disclosed herein as illustrative examples. In one embodiment, a lighting system comprises a track member including a base for mounting the track to a surface, the track member having first and second arms extending from the base in a common direction and defining therebetween a channel, and a lighting unit having a housing adapted to be received in the channel of the track assembly. The housing and at least one of the arms of the track member have rotationally interfering members for restricting rotation of the lighting unit relative to the track member when the at least one arm is in a first position, said at least one arm being moveable to a second position whereat the lighting assembly can be rotated relative to the track.

The rotationally interfering members can include at least one mating recess or protrusion associated with the at least one arm, and at least one mating recess or protrusion associated with the lighting unit. The at least one mating recess or protrusion associated with the track member and lighting unit can include axially extending ribs or grooves provided on the exterior surface of the housing of the lighting unit and the interior surface of the at least one arm. The at least one arm can be adapted to pivot from the first position to the second position when a threshold rotational force is applied to the lighting unit. The housing of the lighting assembly is generally tubular and the first and second arms of the track member are configured to closely receive the lighting unit on opposing sides thereof. The lighting unit can include a non-circular axially extending protrusion or recess for cooperating with a tool for applying rotational force to the lighting unit. The angular position of the lighting unit can be adjusted in increments corresponding to the dimensions of the mating recesses and protrusions. The track member can be made of a plastic material, for example.

BRIEF DESCRIPTION OF THE DRAWINGS

The invention may take form in various components and arrangements of components, and in various process operations and arrangements of process operations. The drawings are only for purposes of illustrating embodiments and are not to be construed as limiting the invention.

DETAILED DESCRIPTION OF PREFERRED EMBODIMENTS

Figure 1:
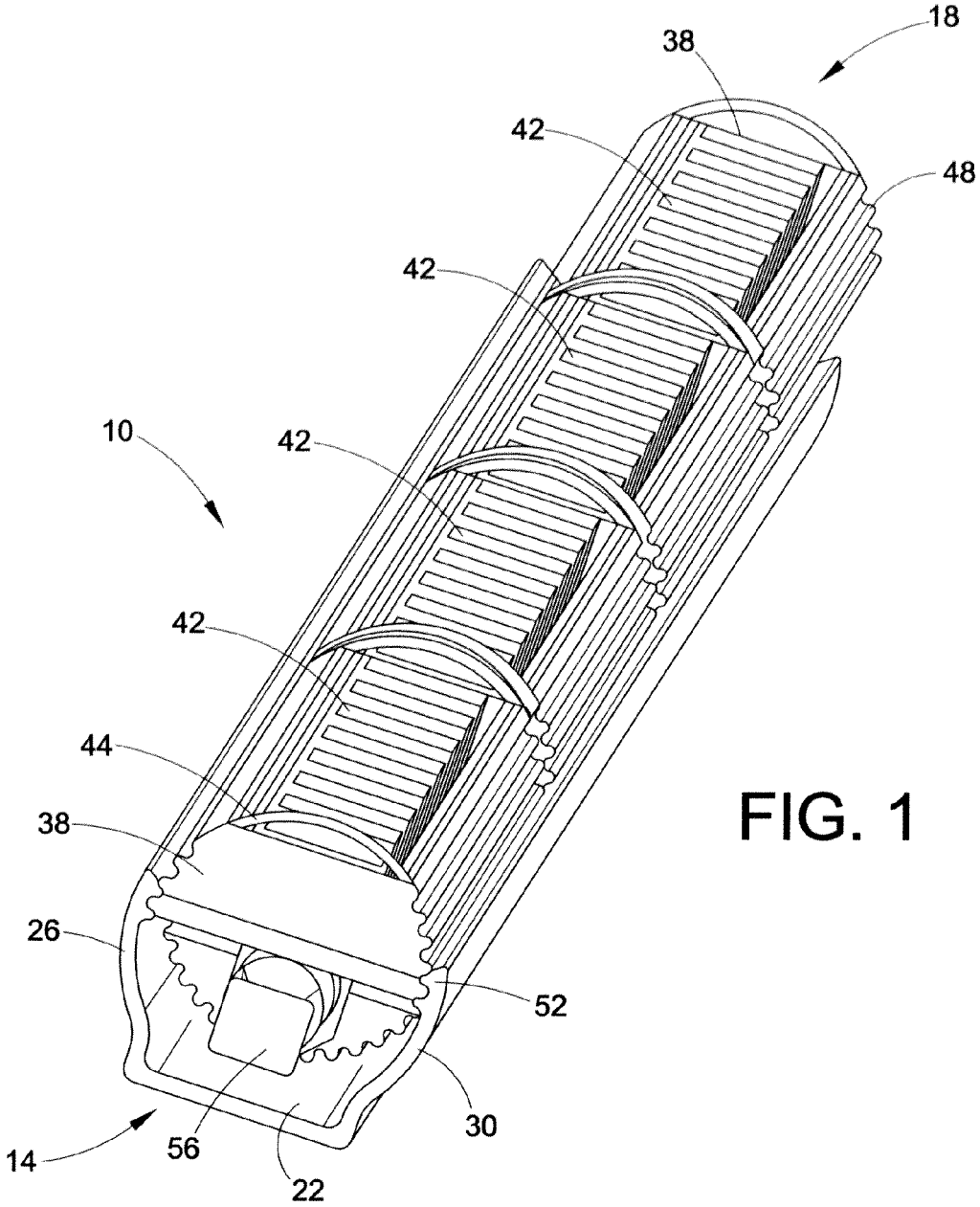
FIG. 1 is a perspective view of an exemplary lighting system in a first angular position in accordance with the present disclosure.
Figure 2:
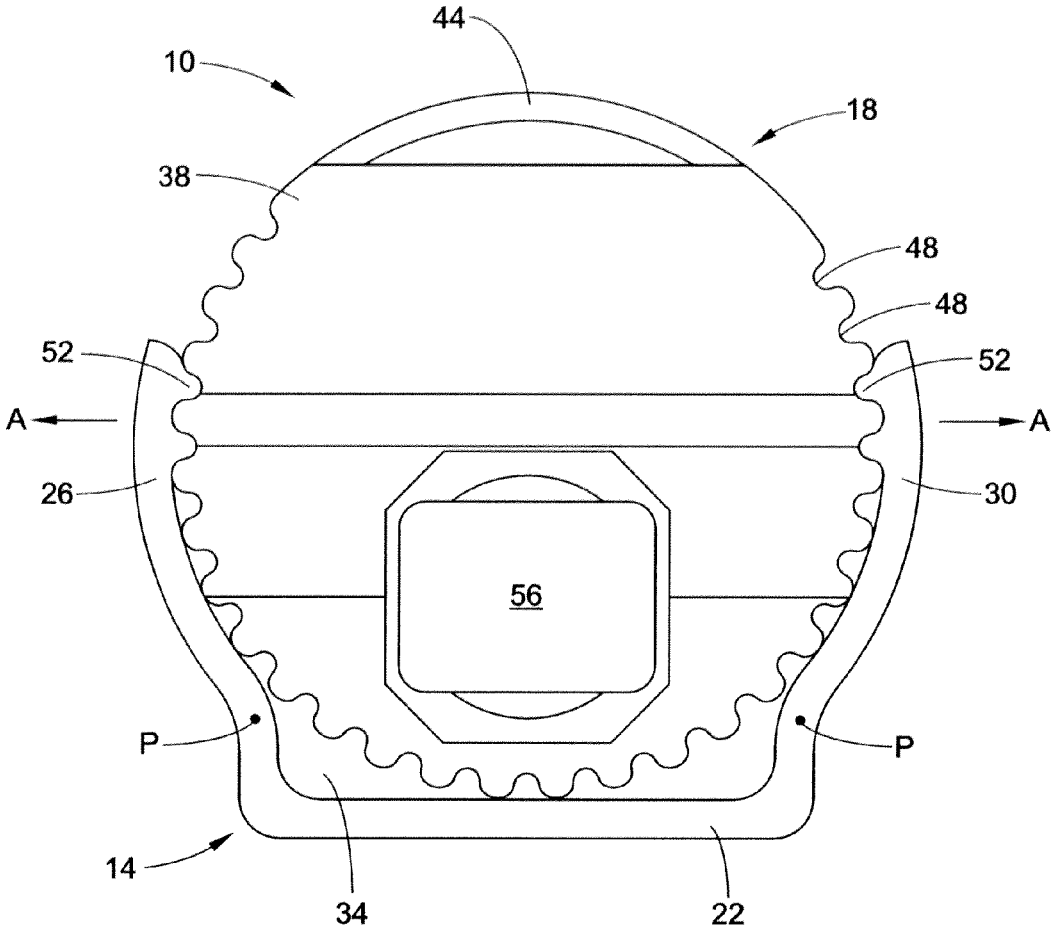
FIG. 2 is an end view of the lighting assembly of FIG. 1.
Figure 4:
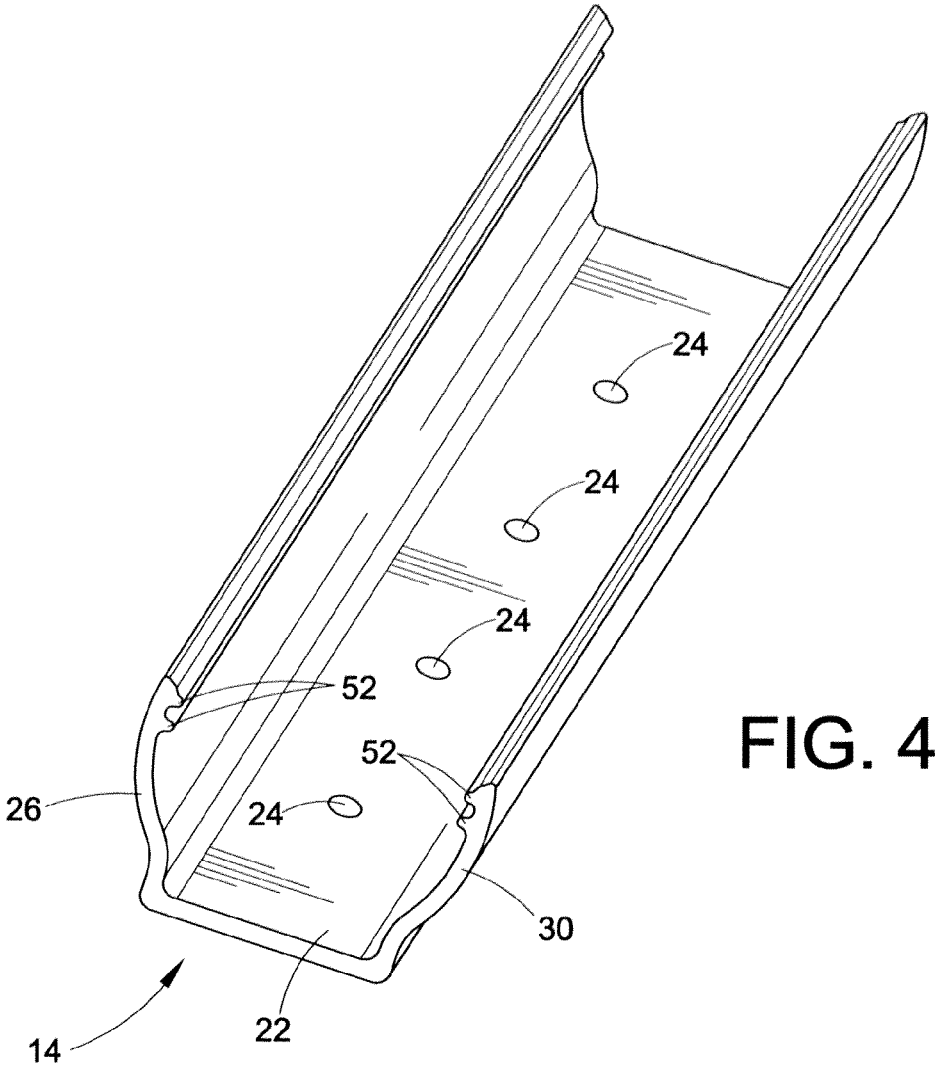
FIG. 4 is a perspective view of an exemplary track in accordance with the present disclosure.

Turning now to the drawings, and initially to FIGS. 1 and 2, an exemplary lighting system is generally indicated by reference numeral 10. The system 10 generally includes a track member 14 and a lighting unit 18 supported by the track member 14. The track member 14 includes an elongate base 22 for mounting the track member 14 to a surface, such as a wall, frame, etc. The base 22 can include a plurality of holes 24 (see FIG. 4) for installing fasteners or the like. A pair of arms 26 and 30 extend from the base 22 in a common direction and define therebetween a channel 34 for receiving the lighting unit 18. As will be appreciated, the arms 26 and 30 include a curved portion thereof that is generally shaped to match an outer surface of the lighting unit 18 such that the lighting unit 18 is closely received within the channel 34. As will be described in more detail below, arms 26 and 30 include are configured to pivot about respective pivot points P. The track member 14 can be made as a unitary piece as illustrated, or may be assembled from individual components.

The lighting unit 18 includes a housing 38 for supporting lighting elements 42, which may be LEDs or other suitable lighting elements, and other electronic components that may be associated therewith. A clear or otherwise translucent lens 44 can be provided over the lighting elements 42. The lens can contain different optics to generate different viewing angles, and could be modular so that for different viewing angles of lens used on the LED, the track can be mounted at different distances from the wall and adjusted for rotation for the most uniformity on the wall or surface. As will be appreciated, however, any suitable type of lighting element can be used.

The housing 38 is generally cylindrical (although other shapes are contemplated including oblong, for example) and includes a plurality of longitudinally extending recesses in the form of grooves 48 around a major portion of its circumference. The grooves 48 are adapted to cooperate with correspondingly shaped protrusions in the form of longitudinally extending ridges 52 on the arms 26 and 30 for restricting rotation of the lighting unit 18 relative to the track member 14. These rotationally interfering members not only restrict rotation of the lighting unit when the arms 26 and 30 are in the position illustrated in FIGS. 1 and 2, but also cooperate to retain the lighting unit 18 in the track member 14. That is, when the ridges 52 are received within the grooves 48, the lighting unit 18 is secured to the track and rotation of the lighting unit 18 relative to the track member 14 is restricted.

As will be appreciated, to install the lighting system 10, the track is first secured to surface. The lighting unit 18 is then inserted into the channel 34 in the track member 14. As the housing 38 impinges upon the arms 26 and 30, the arms 26 and 30 are outwardly displaced to accommodate the lighting unit 18 in the channel 34. The arms 26 and 30 are dimensioned such that this outward displacement occurs as a result of the lighting unit 10 being urged into place, and no other action is required by an installer to seat the lighting unit 18 in the track member 14.

In order to apply a sufficient force to the housing 38 to secure the lighting unit 18 and to restrict rotation, the arms 26 and 30 and/or base 22 can be made of a material, such as plastic, that provides some resiliency to the arms 26 and 30 such that after the outward displacement during installation or as will be described below, angular adjustment of the lighting unit 18, the arms 26 and 30 "spring" back to the position shown in FIGS. 1 and 2. This resiliency can be achieved not only through the selection of a suitable material, but also through the shape of the arms 26 and 30. For example, in the illustrated embodiment, the arms 26 and 30 are adapted to pivot about respective pivots points P when deflected outwardly. In addition, and as will be described in more detail below, a track retainer can be installed for providing additional retention for certain installations, such as a hanging installation.

To adjust the angular position of the lighting unit 18 once installed in the track member 14, a rotational force is applied to the housing 38. This rotational force can be applied by hand or via a suitable tool designed to engage the housing 38. In the exemplary embodiment, a non-circular protrusion in the form of a rectangular head 56 extends from the housing 38 for engagement with a suitable tool, such as a wrench, for applying rotational force to the housing 38. Of course, the rectangular head 56 could also be grasped by a user's fingers and rotated.

As will now be appreciated, when a rotational force is applied to the housing 38 that exceeds a threshold amount, the intermeshed surfaces of grooves 48 and ridges 52 begin to slide relative to each other and a camming action therebetween causes the arms 26 and 30 to be displaced outward, in the direction of arrows A, until the ridges 52 of the arms 26 and 30 clear the radially outer surface of the housing 38 thereby permitting the lighting unit 18 to rotate.

Figure 3:
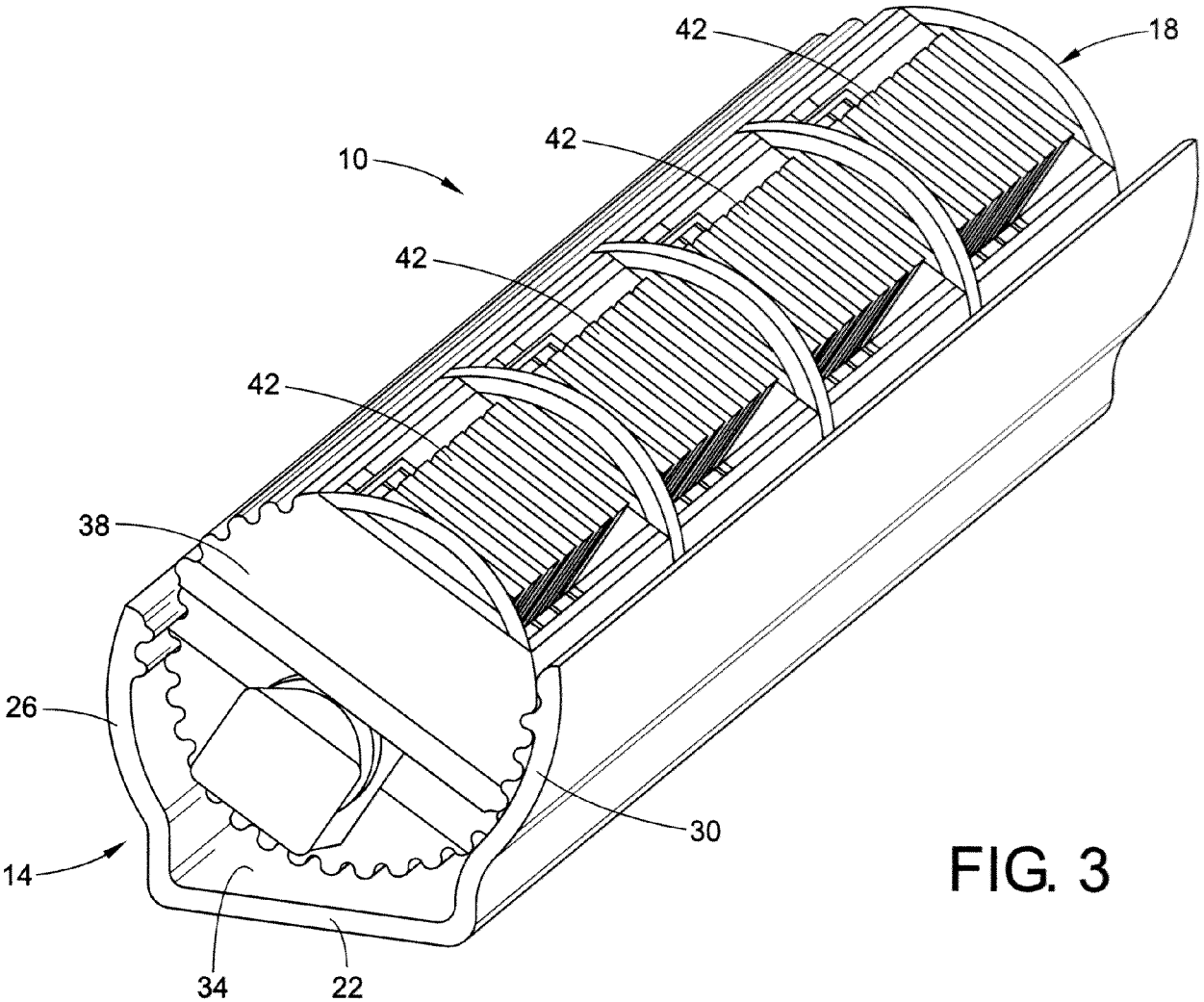
FIG. 3 is a perspective view of the lighting assembly if FIG. 1 rotated to a second angular position

Turning to FIG. 3, the lighting system 10 is shown in a rotated position wherein the lighting unit 18 has been rotated within the track member 14 as compared to the position of FIGS. 1 and 2. The angular position of the lighting unit 18 can be adjusted in increments corresponding to the dimensions and/or spacing of the cooperating grooves 48 and ridges 52. For example, for very fine adjustment, more grooves 48 can be provided on the housing 38. Conversely, for more coarse adjustment, fewer grooves 48 may be provided. Alternatively, the grooves 48 could be spaced apart at particular intervals corresponding to specific angles. For example, grooves corresponding to 30 degrees, 45 degrees, 60 degrees, etc. could be provided. To indicate these grooves as corresponding to particular angles, the grooves could be shaped differently than grooves corresponding to other angular positions in between. Alternatively, markings could be provided on the housing 38 to indicate the angle to which a given groove corresponds.

The threshold rotational force needed to displace the arms 26 and 30 outwardly in order to rotate the lighting unit 18 can be, at least in part, a property of the material of the arms 26 and 30. The shape or profile of the grooves 48 and ridges 52 can also effect the threshold force. For example, a steeper profile may require increased force whereas a more gradual profile may require less force. To this end, it will be understood that a desired threshold force can be achieved by altering such design parameters. Further, the grooves 48 and/or ridges 52 may not be continuous along their axial lengths such that a given cooperating groove/ridge may not be engaged along its entire axial length. Such arrangement would tend to decrease the threshold force.

Although not shown in the drawings, a suitable locking mechanism could be provided for preventing angular adjustment or removal of the lighting assembly from the track member. Such locking mechanism could take the form of a clip that connects the arms 26 and 30 thereby preventing outward displacement of the arms 26 and 30 until such time as the clip is removed.

Figure 5:
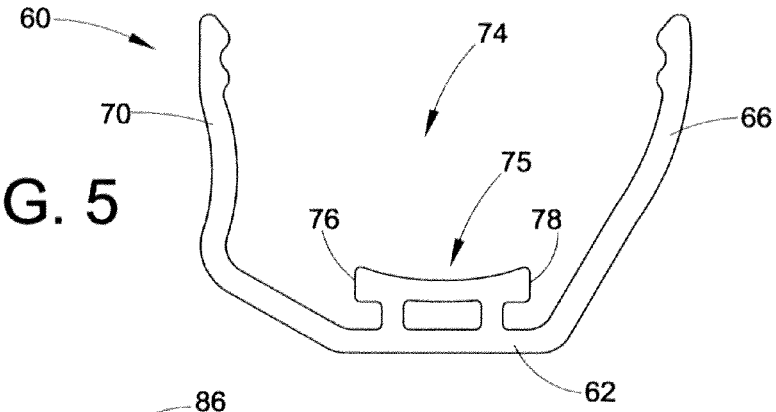
FIG. 5 is an end view of another exemplary track in accordance with the present disclosure.

Turning now to FIG. 5, an end view of another exemplary track member 60 is illustrated. Like the embodiment of the track member 14 shown in the previous figures, the track member 60 includes an elongate base 62 for mounting the track member 60 to a surface, such as a wall, frame, etc., and a pair of arms 66 and 70 extending from the base 62 in a common direction and defining therebetween a channel 74 for receiving a lighting unit. Unlike track member 14, however, the arms 66 and 70 are asymmetric, with arm 66 extending laterally away from the base 62 a greater distance than arm 70. This offset arrangement of the arms 66 and 70 may tend to direct a lighting unit, when installed therein, towards a certain angular orientation. Moreover, track member 60 can be used in certain installations having limited space and/or obstructions adjacent the mounting surface.

Track member 60 also has a rail 75 spaced from the elongated base 62 and extending in a common direction therewith. Rail 75 has an upper concave surface, and first and second flanges 76 and 78. As will be described in more detail below, the flanges 76 and 78 are adapted to cooperate with corresponding flanges on a track retainer to provide additional retention to secure an associated lighting unit to the track member 60.

Figure 6:
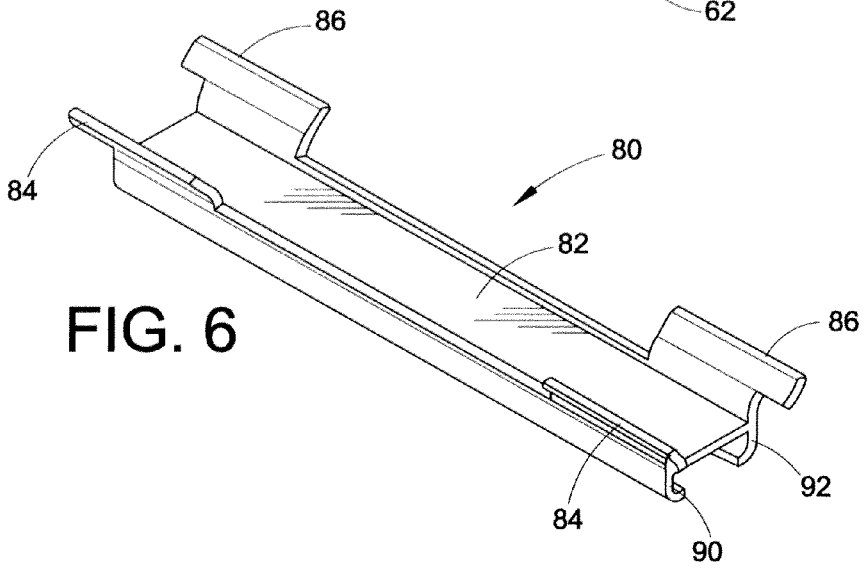
FIG. 6 is a perspective view of an exemplary track retainer in accordance with the present disclosure.
Figure 7:
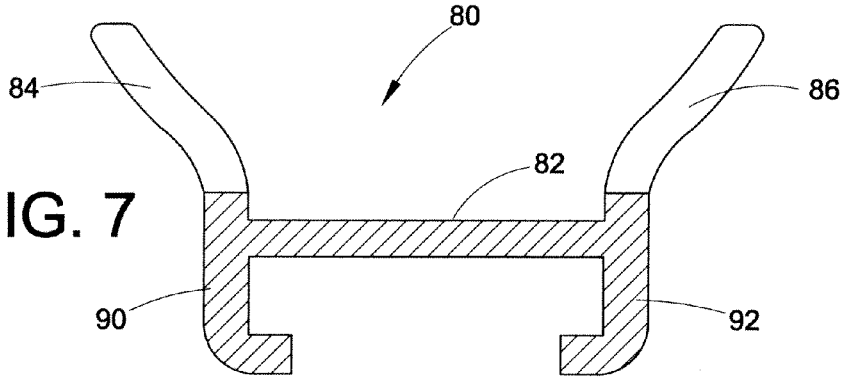
FIG. 7 is an end view of the track retainer of FIG. 6.

In FIGS. 6 and 7, an exemplary track retainer 80 is shown for use in conjunction with a track member (such as track member 60 described above) for providing additional retaining force to a lighting unit. The track retainer 80 may have particular application in hanging installations, wherein it may be desirable to provide an enhanced level of retention of the lighting unit in the track member.

The track retainer 80 includes an elongated base 82 defining a generally planar surface, and front and rear retention members in the form of left and right flying tabs 84 and 86 extending from the base 82. Each pair of tabs 84 and 86 is adapted to cradle a portion of a lighting unit. In this regard, the tabs 84 and 86 can be configured to engage and/or interlock with a corresponding surface of an associated lighting unit. First and second flanges 90 and 92 extend from the base 82 opposite the tabs 84 and 86, and are adapted to engage the flanges 76 and 78 of the track member 60, for example.

Figure 8:
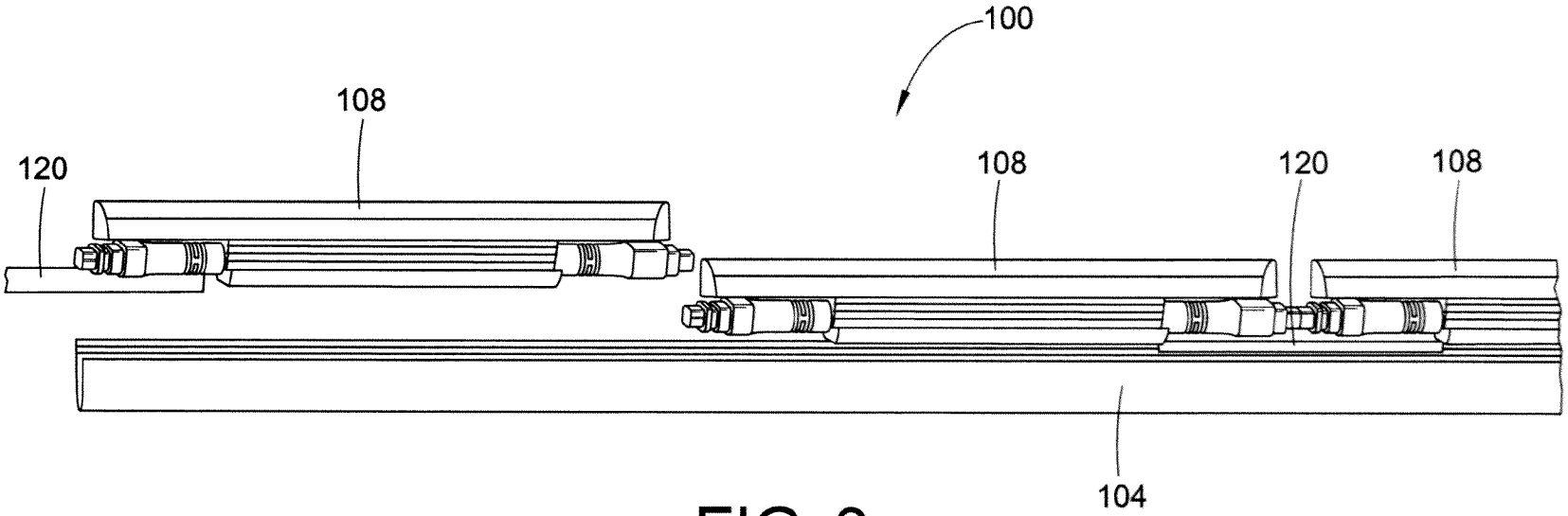
FIG. 8 is a side elevational view of another exemplary lighting assembly.
Figure 9:
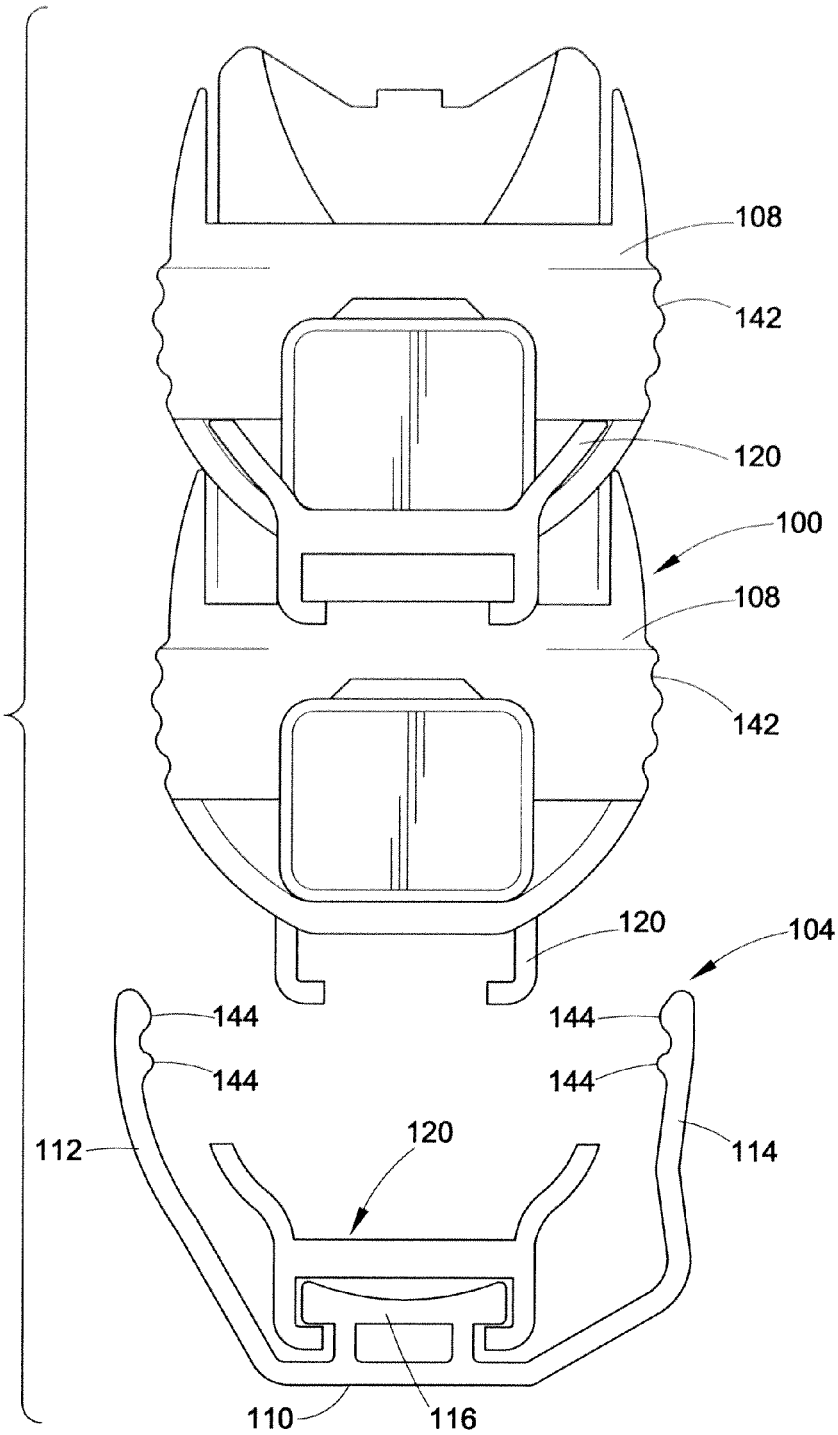
FIG. 9 is an end view of the lighting assembly of FIG. 8 in a partially assembled state.
Figure 10:
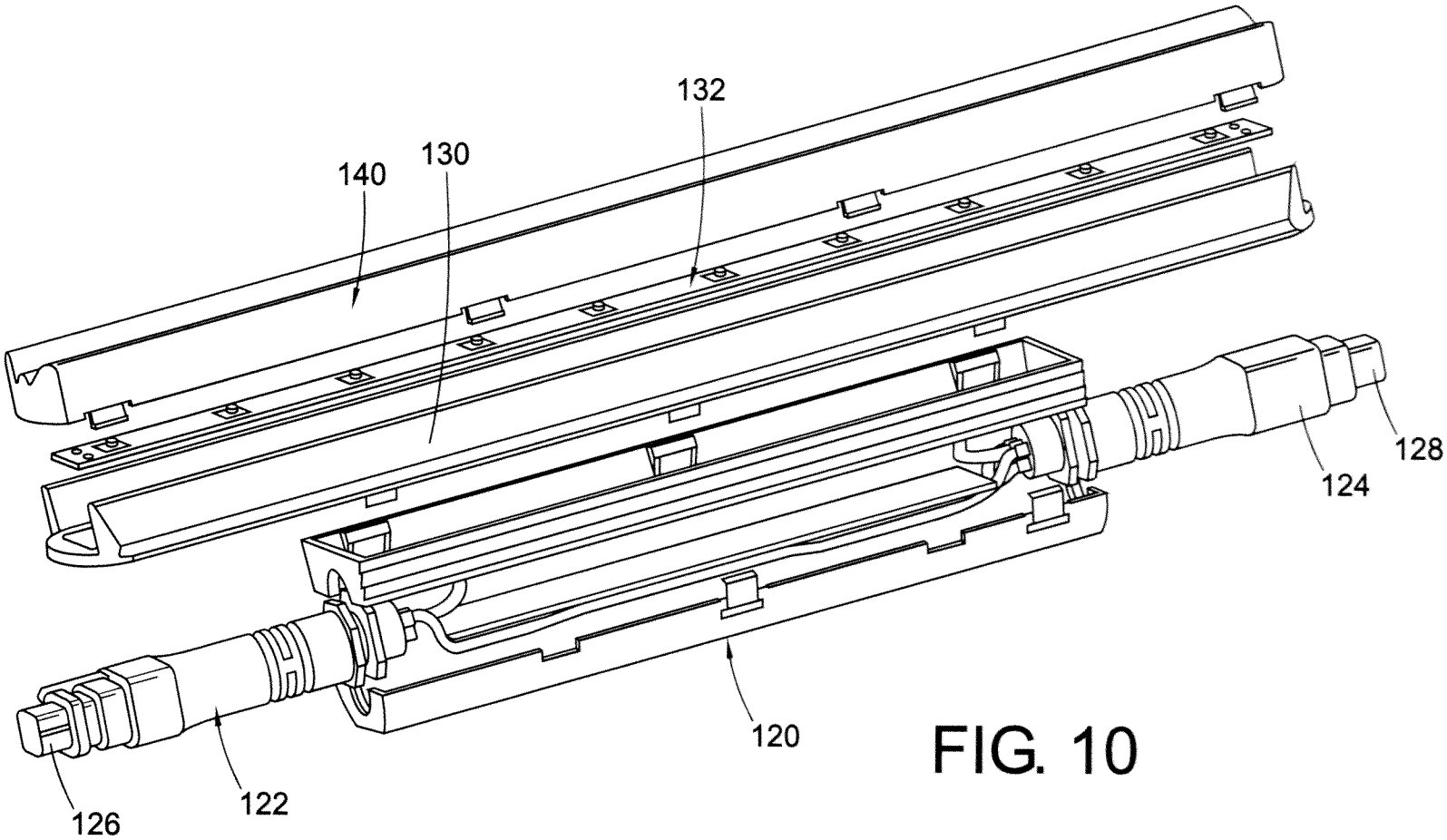
FIG. 10 is an exploded view of an exemplary lighting unit.
Figure 11:
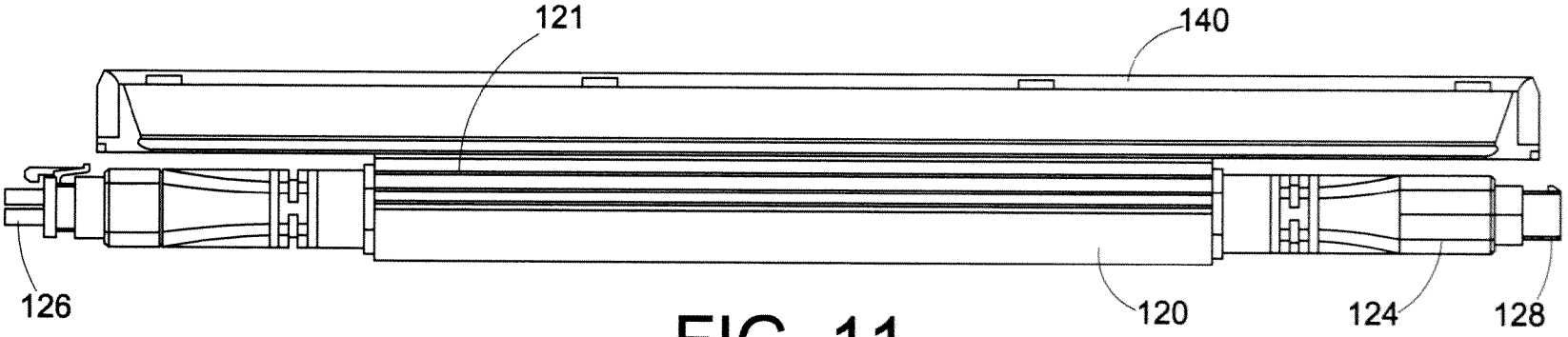
FIG. 11 is a side elevational view of the lighting unit of FIG. 10.
Figure 12:
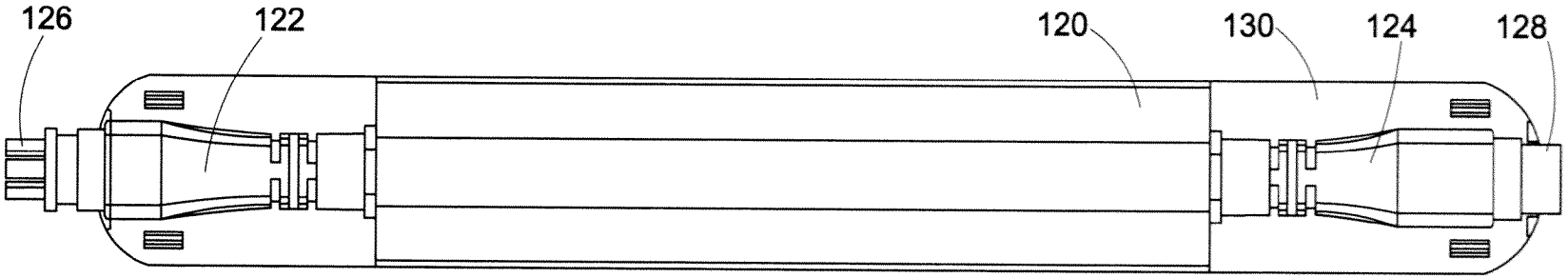
FIG. 12 is a bottom view the lighting unit of FIG. 10.
Figure 13:
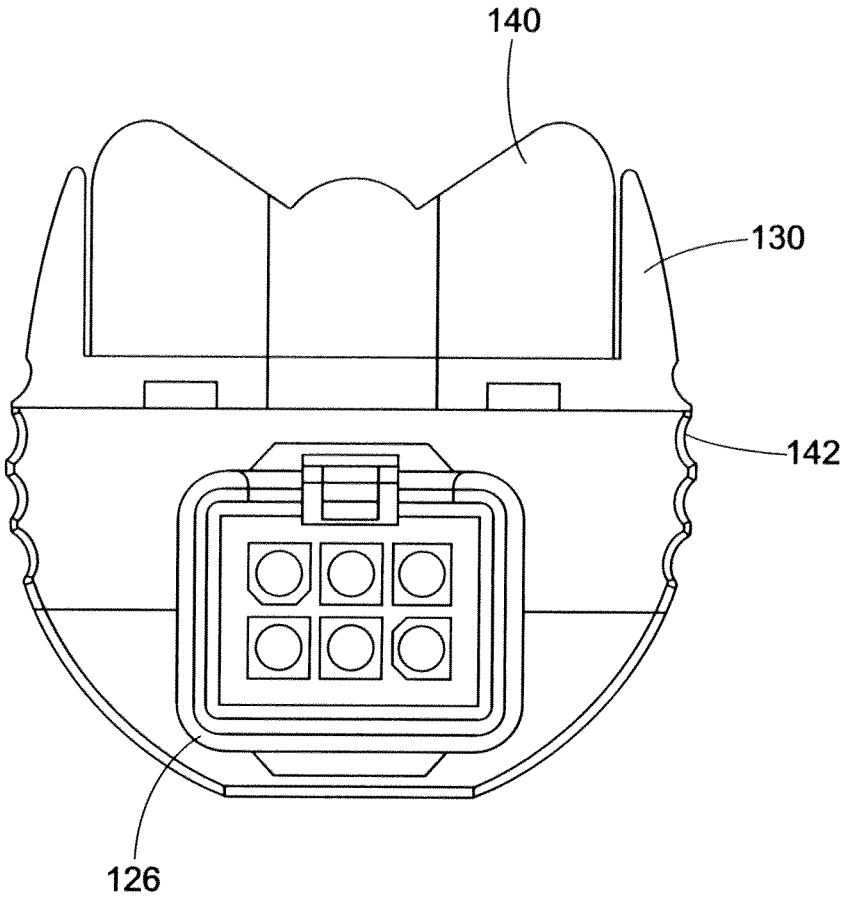
FIG. 13 is an end view of the lighting unit of FIG. 10.

Turning now to FIGS. 8 and 9, another exemplary lighting assembly is illustrated and generally identified by reference numeral 100. In this embodiment, a single track 104 is designed to accommodate a plurality of lighting units 108. In the exemplary embodiment, there are three lighting units 108 shown, but any number of lighting units could be installed as desired. The track 104 is identical to the track 60 described previously and includes an elongated base 110, first and second offset arms 112 and 114 extending from said base, and a rail 116.

In this embodiment, the lighting units 108 are secured to the track 104 in a similar manner as the embodiment of FIGS. 1-4, and further track retainers 120 are installed on rail 116 and act to further secure the lighting units 108 to the track member 104. As will be appreciated, each track retainer 120 is received on rail 116 between adjacent lighting units 108. Typically, the track retainers 120 are positioned between respective lighting units 108 and then said lighting units are installed to the track 104 with the flying arms of the track retainer cooperating with corresponding tabs on the housing of the lighting units 108. Of course, the arms 112 and 114 of the track 104 also engage and secure the lighting units 108 to the track 104, in a similar manner to that previously described.

In FIGS. 10-13, the details of the exemplary lighting unit 108 are illustrated. In this embodiment, the lighting unit 108 includes a base housing 120, and upper housing 121, and first and second wire harnesses 122 and 124 including connectors 126 and 128. A heat sink 130 partially surrounds an LED circuit board 132. A lens 140 covers the LED circuit board 132. As will be appreciated, an exterior surface of the upper housing 121 includes a plurality of grooves 142 for cooperating with mating protrusions 144 on the arms 112 and 114 of the track 104 for restricting rotation of the lighting unit 108 and/or securing the lighting unit 108 to the track 104.

It will now be appreciated that the present disclosure provides a lighting system that facilitates simple installation and one-step angular adjustment. The system provides an angular adjustment mechanism without moving parts thus making the system easy to manufacture, install and adjust. Further, any suitable number of lighting units can be installed in a given track member, and each individual lighting unit can be adjusted to a desired angular position without removal from the track member.

The preferred embodiments have been illustrated and described. Obviously, modifications, alterations, and combinations will occur to others upon reading and understanding the preceding detailed description. It is intended that the invention be construed as including all such modifications and alterations insofar as they come within the scope of the appended claims or the equivalents thereof.

What is claimed is:

1. A lighting system comprising:

a track member including a base for mounting the track to a surface, the track member having first and second arms extending from the base in a common direction and defining therebetween a channel; and a lighting unit having a housing adapted to be received in the channel of the track member;

wherein the housing and at least one of the arms of the track member have rotationally interfering members for restricting rotation of the lighting unit relative to the track member when the at least one arm is in a first position, said at least one arm being moveable to a second position whereat the lighting assembly can be rotated relative to the track member; and wherein the rotationally interfering members include at least one mating recess or protrusion associated with the at least one arm, and a plurality of mating recesses or protrusions spaced around a major portion of a circumference of the lighting unit, whereby the lighting unit can be positioned within the channel in a plurality of angular positions with the rotationally interfering members engaged.

2. A lighting system as set forth in claim 1, wherein the at least one mating recess or protrusion associated with the track member and lighting unit includes axially extending ribs or grooves provided on the exterior surface of the housing of the lighting unit and the interior surface of the at least one arm.

3. A lighting system as set forth in claim 1, wherein at least one arm is adapted to pivot from the first position to the second position when at least a threshold rotational force is applied to the lighting unit.

4. A lighting system as set forth in claim 1, wherein the housing of the lighting assembly is generally tubular and the first and second arms of the track member are configured to closely receive the lighting unit on opposing sides thereof.

5. A lighting assembly as set forth in claim 1, wherein the lighting unit includes a non-circular axially extending protrusion or recess for cooperating with a tool for applying rotational force to the lighting unit.

6. A lighting assembly as set forth in claim 1, wherein the angular position of the lighting unit is adjustable in increments corresponding to the dimensions of the mating recesses and protrusions.

7. A lighting assembly as set forth in claim 1, wherein the first and second arms are mirror images of each other.

8. A lighting assembly as set forth in claim 1, wherein the first arm extends laterally away from a longitudinal axis of the base a greater distance than the second arm extends laterally away from the longitudinal axis of the base such that the first and second arms are offset.

9. A lighting assembly as set forth in claim 1, further comprising a track retainer, wherein the track retainer is interposed between the track member and the lighting unit.

10. A lighting assembly as set forth in claim 9, wherein the track retainer is secured to a rail of the track member.

11. A lighting assembly as set forth in claim 9, wherein the track member includes a rail extending along the base for cooperating with at least one flange on the track retainer for releasable securing the track retainer to the track member.

12. A track member for rotationally supporting an associated lighting unit, the track member comprising:

a base having a bottom wall and two side walls extending from the bottom wall for mounting the track to a surface;

first and second curved arms extending from respective side walls of the base in a common direction and defining therebetween a channel having curved side walls for receiving the associated lighting unit, distal ends of the first and second arms terminating at a location laterally spaced from the each respective sidewall such that a mouth of the channel is wider than the base;

wherein at least one of the arms of the track member has a rotationally interfering member for cooperating with a corresponding rotationally interfering member associated with the lighting unit for restricting rotation of the lighting unit relative to the track member when the lighting unit is received in the channel.

13. A track member as set forth in claim 12, wherein the first and second arms are adapted to pivot between a first position whereat rotation of the lighting unit is restricted, to a second position permitting rotation of the lighting unit relative to the track member.

14. A track member as set forth in claim 12, further comprising a raised rail member extending along a longitudinal axis of the base.

15. A track member as set forth in claim 12, wherein the track member is made of a plastic material.

* * * * *